US011605519B1

(12) United States Patent
Leung

(10) Patent No.: US 11,605,519 B1
(45) Date of Patent: Mar. 14, 2023

(54) HIGH BREAKING CAPACITY STRIP FUSE AND THE MANUFACTURE METHOD OF THEREOF

(71) Applicant: CHI LICK SCHURTER LIMITED, Tsuen Wan (HK)

(72) Inventor: Bengi Koon Yui Leung, Tsuen Wan (HK)

(73) Assignee: CHI LICK SCHURTER LIMITED, Tsuen Wan (HK)

( * ) Notice: Subject to any disclaimer, the term of this patent is extended or adjusted under 35 U.S.C. 154(b) by 0 days.

(21) Appl. No.: 17/525,134

(22) Filed: Nov. 12, 2021

(51) Int. Cl.

| | |
|---|---|
| ***H01H 85/11*** | (2006.01) |
| ***H01H 85/041*** | (2006.01) |
| ***H01H 69/02*** | (2006.01) |
| ***H01H 85/143*** | (2006.01) |
| ***H01H 85/165*** | (2006.01) |

(52) U.S. Cl.
CPC ..... *H01H 85/041* (2013.01); *H01H 69/02* (2013.01); *H01H 85/11* (2013.01); *H01H 85/143* (2013.01); *H01H 85/165* (2013.01)

(58) Field of Classification Search
CPC ..... H01H 69/02; H01H 85/041; H01H 85/11; H01H 85/143; H01H 85/165; H01H 85/1755; H01H 85/18
See application file for complete search history.

(56) References Cited

U.S. PATENT DOCUMENTS

| | | | | | |
|---|---|---|---|---|---|
| 5,270,679 | A * | 12/1993 | Gulbrandsen | H01H 85/18 | 337/248 |
| 5,673,014 | A * | 9/1997 | Domanits | H01H 85/11 | 337/160 |
| 5,898,357 | A * | 4/1999 | Endo | H01H 85/11 | 337/159 |
| 5,900,798 | A * | 5/1999 | Hanazaki | H01H 85/11 | 337/159 |
| 6,075,434 | A * | 6/2000 | Rueckling | H01H 85/11 | 337/296 |
| 2009/0189730 | A1* | 7/2009 | Oh | H01H 85/10 | 337/186 |
| 2017/0040136 | A1* | 2/2017 | Straub | H01H 85/205 | |

* cited by examiner

*Primary Examiner* — Jacob R Crum
(74) *Attorney, Agent, or Firm* — Muncy, Geissler, Olds & Lowe, P.C.

(57) ABSTRACT

The present invention relates to a high breaking capacity strip fuse, comprising an insulating housing and a fusing element. The fusing element includes a fusible part, a first connecting terminal and a second connecting terminal which are arranged at two ends of the fusible part and are integrally connected with the fusible part; the fusible part is fixed in the sealed cavity of the housing, and the sealed cavity is filled with insulating material. The present invention provides a fuse filling with insulating material, such as Silicone, quartz sand, resin, ceramic powder/ceramic sand, steatite powder/steatite sand, or saponite powder/saponite granules, in the sealed cavity, to solve the problem of causing the air to ionize and triggering arcing phenomenon of existing fuse during overload.

8 Claims, 8 Drawing Sheets

HIGH BREAKING CAPACITY STRIP FUSE AND THE MANUFACTURE METHOD OF THEREOF

FIELD OF THE INVENTION

The invention relates to a fuse, especially a high breaking capacity strip fuse.

BACKGROUND OF THE INVENTION

The fuse is a disposable component connected to a circuit for protecting the circuit. When the current is over load, the metal sheet or metal wire of the fuse generates high temperature and melts to interrupt current by cut off the circuit for the protecting the electrical devices such as home appliances, industrial equipment, battery and powered moving objects. However, when the fuse in the prior art is fused at high temperature, the load of the fuse is too large, the fusing will cause air ionization and trigger the arcing phenomenon, also the high temperature generated by the arc will easily destroy the insulating housing, make the fuse invalid and may even burn the objects around, which will cause fire, electric injury and explosion, etc., endanger the safety of users.

Moreover, traditional manufacturers generally use different molds to produce fuses of different sizes/shapes with a specific current value, which will cause high costs and increase the time for mold changes during production.

SUMMARY OF THE INVENTION

The main purpose of the present invention is to provide a strip fuse with high breaking capacity to solve the existing technical problem of causing air ionization and triggering the arcing phenomenon when the fuse is over load.

The present invention provides a high breaking capacity strip fuse, wherein includes an insulating housing and a fusing element, the fusing element includes a fusible part and a first connecting terminal and a second connecting terminal which are arranged at two ends of the fusible part and are integrally connected with the fusible part;

the fusible part is fixed in a sealed cavity of a housing, and the sealed cavity is filled with insulating material;

the surface of the fusible part is soldered with a tin layer.

In some embodiments, the fusible part is built with a groove for restricting the tin layer at the correspondent position, and the tin layer covers and fills the groove.

In some embodiments, the tin layer cover ⅕ to ½ area of the fusible part.

In some embodiments, the fusible part is built with through holes. The through holes can change the resistance of the fusible part with different through holes to adapt to different rated currents.

In some embodiments, the through holes are rectangle, round or profiled holes. And the through holes are arranged on the fusible part.

In some embodiments, the fusing element is built with plating or degreasing surface. The purpose of plating is to prevent corrosion and reduce the temperature by loading.

In some embodiments, the housing includes a bottom housing, and a cover matched with the bottom housing; the bottom housing is built with two fixing poles, the first connecting terminal and the second connecting terminal are both built with a fixing hole, the fixing hole is inserted into the fixing pole to fix the fusing element in the housing.

In some embodiments, the fixing hole includes a center hole, and an anti-torsion hole arranged at the edge of the center hole, the fixing pole is also composed of a main pole and side poles located on the two sides of the main pole, the main pole is inserted into the center hole, and the side poles are inserted into the anti-torsion hole.

In some embodiments, the housing is built with a filling hole and the insulating material are filled into the housing by the filling hole and fills the cavity of the housing; and the filling hole is built with a plug for sealing.

In some embodiments, the housing includes a bottom housing, and a cover matched with the bottom housing. The bottom housing, cover and the fuse are riveted or assembled by metal part of similar method.

In some embodiments, the insulating material are Silicone, quartz sand, resin, ceramic powder/ceramic sand, steatite powder/steatite sand or saponite powder/saponite granules.

In some embodiments, the insulating material are quartz sand, ceramic powder/ceramic sand, steatite powder/steatite sand or saponite powder/saponite granules mixed with a curing agent; when the insulating material are filled into the housing, they are cured into a solidified shape by the curing agent.

The another purpose of the present invention is to provide a manufacture method of high breaking capacity strip fuse which can quickly change molds, improve production efficiency, reduce the numbers of molds, storage space and costs.

The present invention provides a manufacture method of high breaking capacity strip fuse, wherein includes the following steps:

the shape of the fusing element is punched out by a punch with a mold;

the fusible part is milled to a specific thickness with tight dimensional accuracy according to the rated current of the fuse;

the fusible part is punched into different sizes, numbers, arrangements, combinations of round holes or profiled holes by corresponding mold according to the specific design;

the fusing element is proceeded surface treatment including plating or degreasing, and/or soldering a tin layer on the surface of the fusible part.

Beneficial effects of this invention: the present invention fills insulating material such as silicone, quartz sand, resin, ceramic powder/ceramic sand, steatite powder/steatite sand or saponite powder/saponite granules in the sealed housing of the fuse, which can solve the problem that the fuse of priority art is over loaded, the fusing will cause air ionization and trigger the technical problem of arcing phenomenon.

The realization of the purpose, functional characteristics and advantages of the present invention are further described with the embodiments and the drawings.

DESCRIPTION OF THE EMBODIMENTS

The present invention will be further described below in according with the description of the drawings and the specific embodiments. It should be regards that the specific embodiments described herein are only used to explain the present invention, but are not used to limit the present invention.

Figure 1:
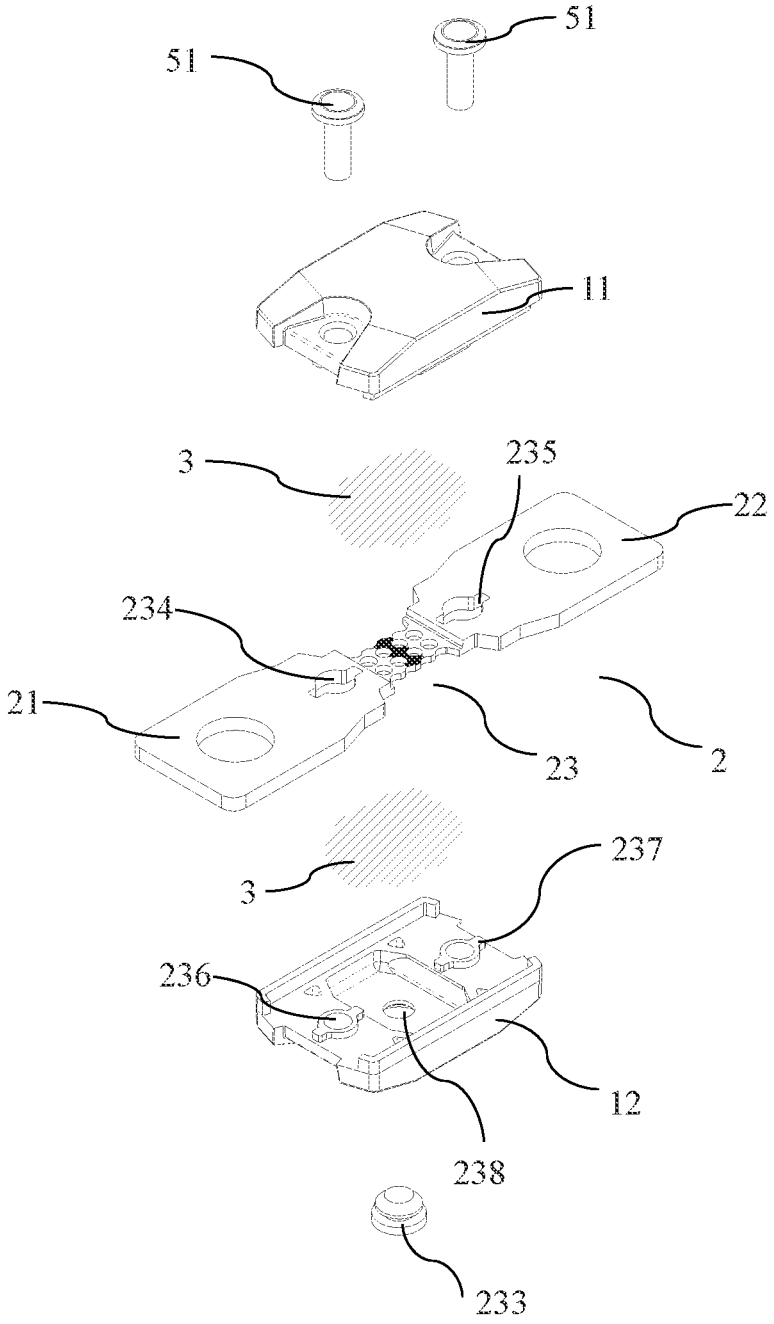
FIG. 1 is an exploded schematic diagram of the present invention.

Embodiment 1, refer to FIG. 1, the present invention provides a high breaking capacity strip fuse, which is used in circuits with different rated currents, and can greatly save production time and cost. The present invention includes the insulating housing 1 and the fusing element 2 which is fixed with the insulating housing 1. The fusing element 2 includes the fusible part 23, the first connecting terminal 21, and the second connecting terminal 22. The first connecting terminal 21 and the second connecting terminal 22 are both connected to the fusible part 23 integrally and fixed to the two end of the fusible part 23. The fusible part 23 is fixed in the sealed cavity of the housing 1, and the sealed cavity is filled with insulating material 3. The insulating material 3 can insulate the air when the fuse is overloaded, to prevent the arcing phenomenon caused when the fusing, and to protect the safety of users.

Specifically, the insulating material 3 are silicone, quartz sand, resin, ceramic powder/ceramic sand, steatite powder/steatite sand or saponite powder/saponite granules, etc. The material of the insulating housing can be plastic, ceramic, glass or bakelite. When the fuse is overload, the fusing will cause air ionization and trigger the arcing phenomenon, the high temperature generated by the arc will easily destroy the insulating housing 1, cause the invalidation of the fuse, and even burn the surrounding objects of the circuit into fire, electric shock and explosion, etc., which endangers the safety of users. Adding filler onto the surface of the fuse can stop the spread of the arc and increase the arc extinguishing ability. In addition, fillers such as silicone, quartz sand, resin, ceramic powder/ceramic sand, steatite powder/steatite sand or saponite powder/saponite granules, etc. can more effectively absorb the heat energy released by the fuse when fusing, and increase the temperature withstand ability, the breaking capacity and the rated voltage value of the fuse.

Generally, granular insulating material 3, such as quartz sand, ceramic powder/ceramic sand, steatite powder/steatite sand or saponite powder/saponite granules, etc., are directly filled into the housing. When there is vibration in the environment, the insulating material 3 will move along with the vibration and cause abrasion on the surface of the fusible part 23, which will inevitably affect the electrical characteristics of the fuse. In order to solve the above problems, the granular insulating material 3 can be mixed with a liquid or granular curing agent. Because the curing agent requires certain conditions to solidify, such as a specific temperature, etc., the insulating material 3 with curing agent is in liquid or granular while filling and is easily filled into the housing. And then according to the characteristics of different curing agents, such as heating or curing at room temperature, the insulating material 3 are cured into a solidified shape, so as to prevent the insulating material 3 from abrading the fusible part 23.

Figure 5:
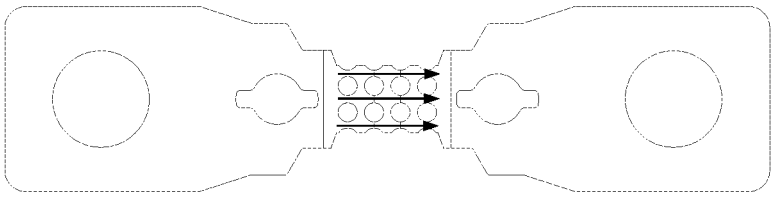
FIG. 5 is a reference diagram of Embodiment 2 of the present invention.

Embodiment 2, as shown in FIG. 8 to FIG. 25, the fusible part 23 is built with a through hole 231. The through hole 231 can be a long strip, a round or profiled hole. The profiled hole includes but is not limited to a zigzag or w shape, etc., and can be arranged uniformly or unevenly. The shape of the fusing element 2 can be stamped out by a punch through a mold, and then the fusible part of the metal sheet is milled from raw materials (such as copper, aluminum, iron, zinc, tin, silver, gold or their alloys, etc.) into specific thickness, which can be made into fuses with different thicknesses for different rated currents. In addition, the width of the fuse also ranges for different rated currents. Then use the common mold principle to change mold parts flexibly according to requirements, such as: punches, inserts, etc., according to the design of the product, put different components of mold parts in the mold, and use a single mold to punch different sizes, numbers, arrangements, combinations of round or profiled hole of the fusible parts. And after finishing the punching, it is only required to proceed the surface treatment of the fusing element 2, such as electroplating, degreasing operations, degreasing or electroplating. So it can produce product degreasing without electroplating or only electroplating. The purpose of electroplating is to prevent corrosion and reduce the temperature during load. This method can quickly change molds, improve production efficiency, reduce the number of molds, storage space and costs. The punching of this fuse is mainly arranged in multiple paths circuit (for example, three paths circuit, as shown in FIG. 5). This design can improve the heat distribution during fusing, help reducing the temperature and enhance the explosion-proof capability during short-circuit. The same type of fuses (fuse, resistance wire) on the market is mainly single path circuit, and the temperature is generally higher during operation.

Figure 3:
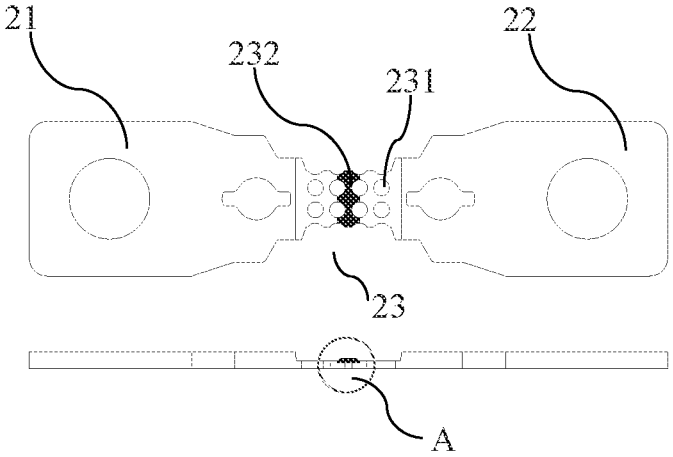
FIG. 3 is a reference diagram of embodiment 3 of the present invention.
Figure 4:
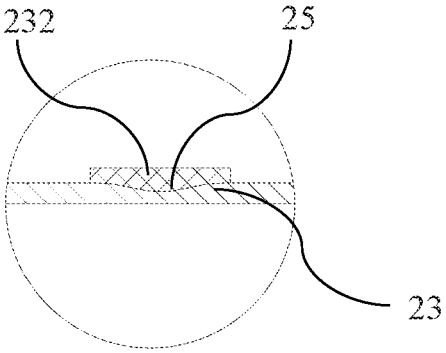
FIG. 4 is a partial enlarged view of A in FIG. 3 of the present invention.

Embodiment 3, as shown in FIG. 1 and FIG. 3, the surface of the fusible part 23 is soldered with a tin layer 232, preferably, the tin layer 232 covers an area of ⅕ to ½ of the fusible part. When soldering the tin layer 232, it is usually finished with automatic/semi-automatic equipment. The fuse is placed on the heating plate and heated by conduction, and then the tin wire being cut into a specified length is heated, and becomes liquid/fluid tin bead, and then the tin bead fall freely onto the center position of the fuse surface. After cooling down, it adheres to cover ⅕ to ½ of the surface of the fusible part 23. When soldering the tin bead (tin layer 232), use the characteristics of the fuse, that is, the fuse is attached to the heating plate to promote heat conduction and prevent the tin bead from being instantaneously cooled and solidified due to temperature differences when contacts with the fuse, making it a non-wetting defect, and can make the tin bead be wetted to the surface of the fuse more effectively. The purpose of the solder bead is to restrict the fusing position of the fusing element 2 and the speed of fusing. Soldering the solder bead to the specific position of the fusible part (mostly at the center point) can make the fusible part 23 fusing at this position, because it is the strongest and most stable place in the structure of the fuse, which can improve the breaking capacity of the fuse. Refer to FIG. 4, in addition, due to the high fluidity of the tin layer in the molten state, it is difficult to accurately control the location of its coverage. For this reason, the groove 25 is provided at the corresponding position of the tin layer 232 in the fusible part. The groove 25 can provide a position where the tin layer can be positioned and reduces the fluidity of the tin, so that the tin layer can be more easily covered in a specific location, and is not easy to disperse due to its high fluidity in the molten state.

Figure 6:
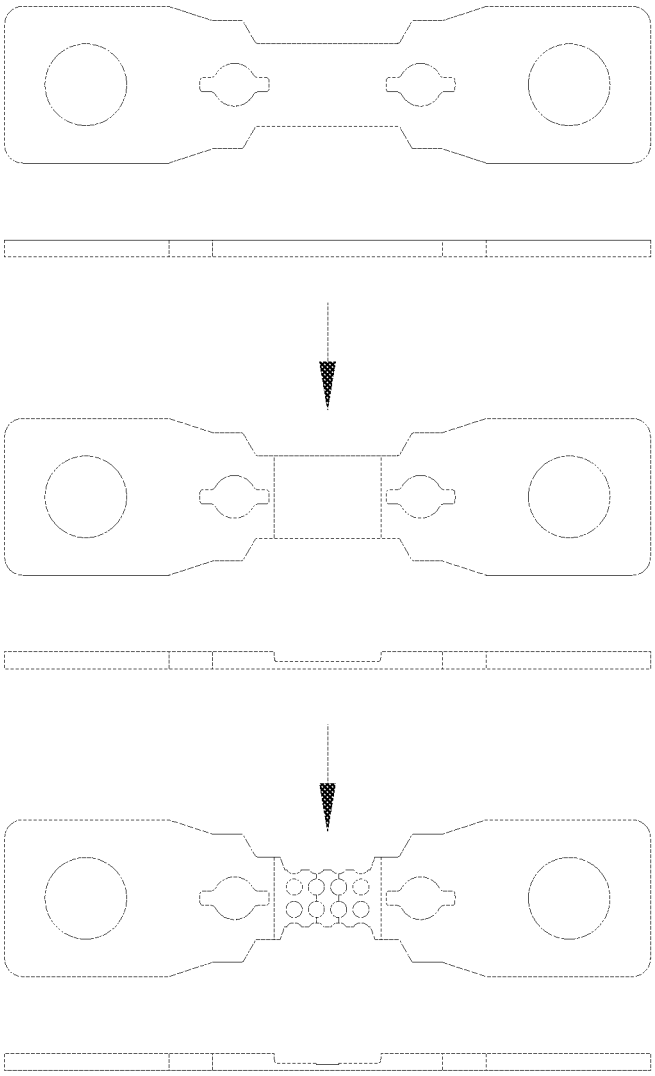
FIG. 6 is a reference diagram of Embodiment 4 of the present invention.

Embodiment 4, as shown in FIG. 6, the thickness of the fusible part may be thinner than the thickness of the first connecting terminal 21 and the second connecting terminal 22. Traditionally, different molds are used to produce fusing element 2 in different sizes/shapes for specific currents of fuse. It will incur high costs and increase the time of changing molds during production. The innovative design of the fuse in the present invention is more advantageous, because the fusing element is firstly punched out by using a punching machine with punching forming mold, and then the milling machine is used to mill the fusible part to a proper thickness. Finally, according to the design of the fusible part, the molds punch out round or profiled holes of different sizes, quantities, arrangements, and combinations. The processing of milling after punching to form the fusible part reduces the forming pressure of the punch on the one hand, and on the other hand, the milling operation can improve the processing accuracy of the thickness of the fusible part 23 to ensure that the fuse has better electrical properties, such as improving fusing characteristics. Preferably, because the thickness of the fuse 23 is thinner than that of the first connecting terminal 21 and the second connecting terminal 22, it is not only to facilitate punching, but also to appropriately change the thickness of the fusing element to adapt to different rated currents.

Figure 2:
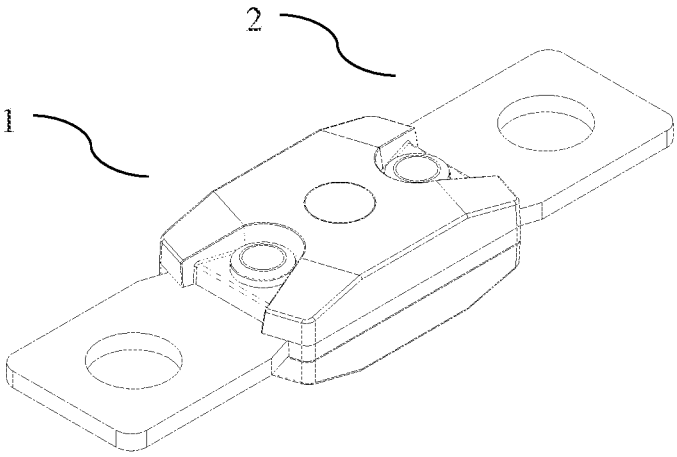
FIG. 2 is a structural diagram of the present invention.

Embodiment 5, as shown in FIG. 1 and FIG. 2, the housing includes the bottom housing 12, and the cover 11 matched with the bottom housing 12. The bottom housing 12 is built with a fixing pole, the first connecting terminal 21 and the second connecting terminal 22 are both built with a fixing hole, the fixing hole is inserted into the fixing pole to fix the fusing element 2 in the housing 1.

When the fuse is installed for use, it needs to be fixed by screws. That will generate torsion or shear force on the fuse during the above operation by user, and may affect the fusible part 23. Such deformation causes deviation of electrical performance, structural function and appearance. In order to reduce above-mentioned influences and apply torsion or shearing force to the housing, the present invention improves the structure of the fixing hole and the fixing pole as follows: the fixing hole includes a center hole 234, and an anti-torsion hole 235 arranged at the edge of the center hole 234, the fixing pole is also composed of a main pole 236 and side poles 237 located on the two sides of the main pole 236, the main pole 236 is inserted into the center hole 234, and the side poles 237 are inserted into the anti-torsion hole 235. The torsion or shear force which is generated during installation of the fuse with the screw can be transmitted to the housing through the anti-torsion hole 235 and the side poles 237, but not to the fusible part 23, thereby reducing the torsion or shearing force to deform the fusible part 23.

Specifically, the method of assembling the insulating material housing 1 belongs to mechanical assembly, and the method is as follows:

1) Rivet fastens:

The bottom housing 12, the fusing element 2 and the cover 11 are assembled and riveted by rivets 51. This method is the strongest. However, the combination method of the housing is not limited to the rivet 51 riveting. The cylinder of insulating material cover 11 is tighten to the hole of corresponding bottom housing 12, and bottom housing 12 cylindrical is melt to fix with cover 11, also the bottom housing 12 and cover 11 can be fixed by snap in with no looseness and make it a sealing effect.

2) Cylinder of the cover 11 tights to the hole of the bottom housing 12:

The bottom housing 12, the fuse and the cover 11 are tightened by inserting the protruding cylinder of the cover 11 into the corresponding hole of the bottom housing 12 without loosening.

3) Bottom housing cylindrical is melt to fix with cover 11:

The bottom housing 12, the fuse and the cover 11 are tightened. The cylinder of the bottom housing 12 corresponds to the hole of the cover 11. After assembling, the cylinder will protrude from the cover 11. Then use high temperature to melt the top of the cylinder and stick to the cover 11 without loosening.

4) The bottom housing 12 and cover 11 can be fixed by snap in:

The bottom housing 12, the fusing element and the cover 11 are tightened, and the snap in the bottom housing buckles to the cover 11 without loosening.

By filling the insulating material 3 around the surface of the fuse fusing part, the present invention can more effectively absorb the thermal energy released by the fuse when fusing, which increase the temperature withstand ability of the fuse and improve the breaking capacity.

Figure 7:
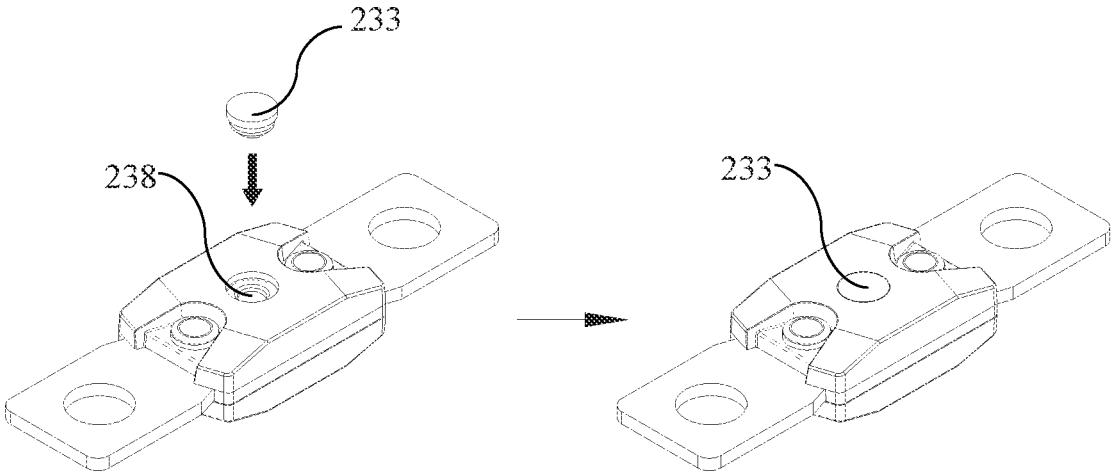
FIG. 7 is the filling structure of the housing of the present invention.
Figure 8:
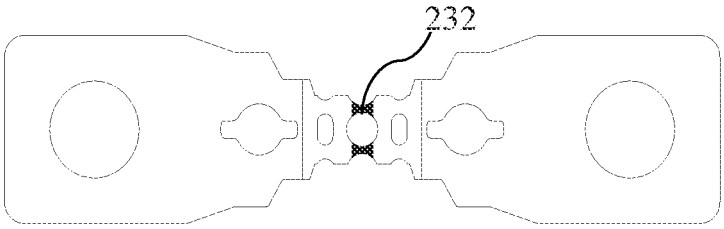
FIG. 8 to FIG. 25 are reference diagrams of embodiment 2 of the present invention.
Figure 9:
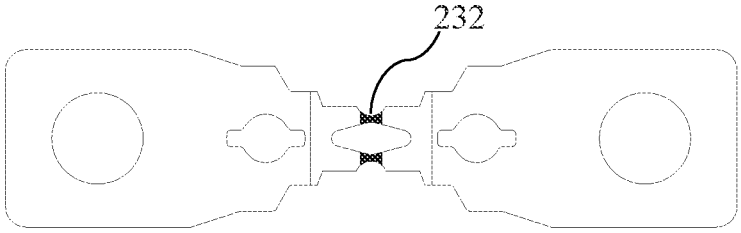
Figure 10:
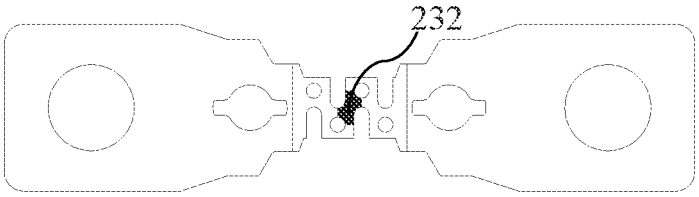
Figure 11:
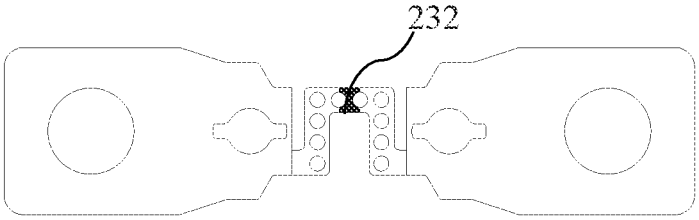
Figure 12:
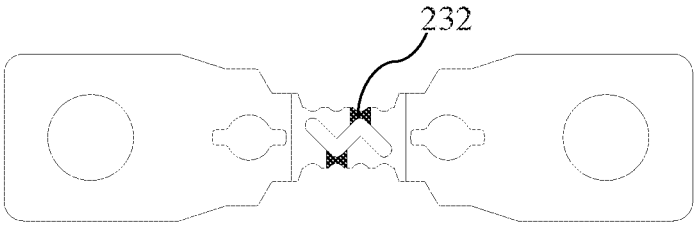
Figure 13:
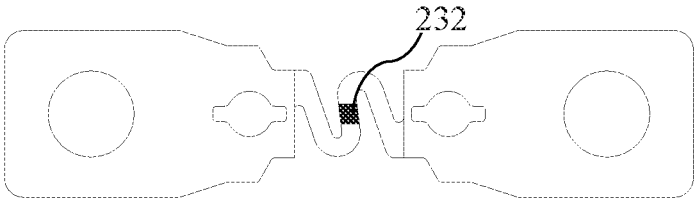
Figure 14:
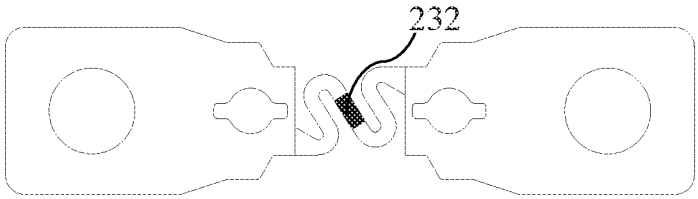
Figure 15:
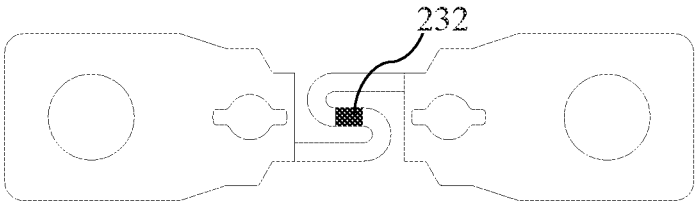
Figure 16:
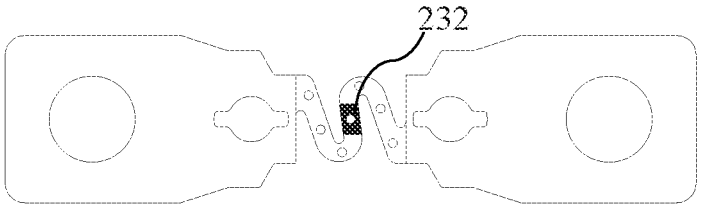
Figure 17:
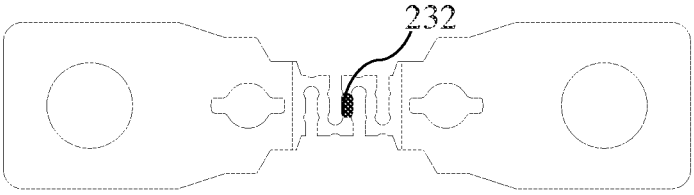
Figure 18:
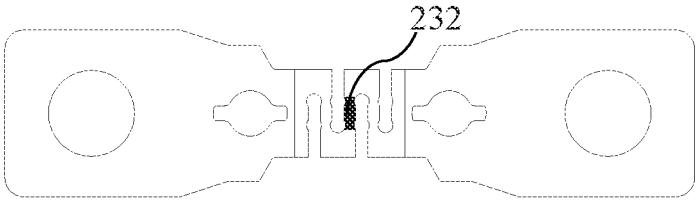
Figure 19:
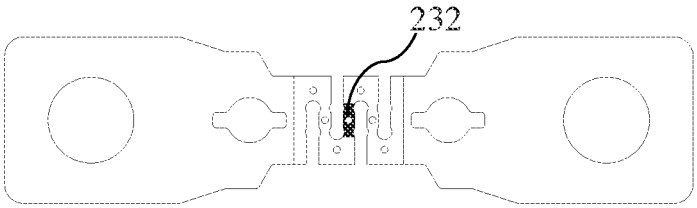
Figure 20:
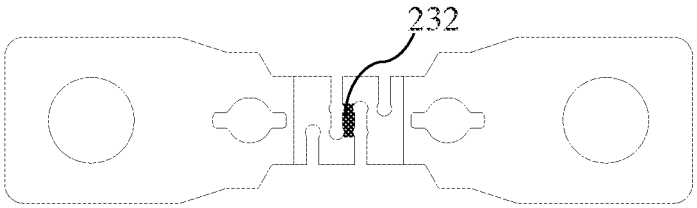
Figure 21:
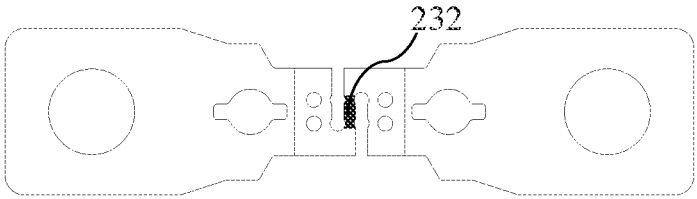
Figure 22:
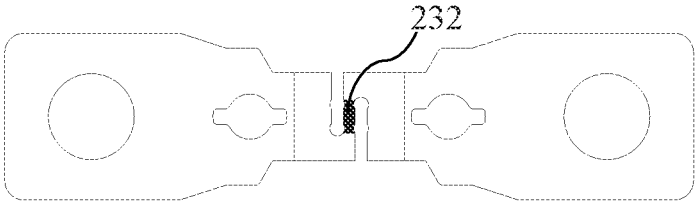
Figure 23:
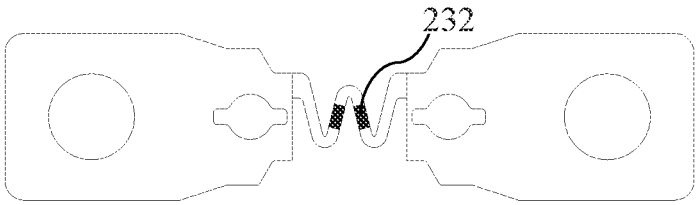
Figure 24:
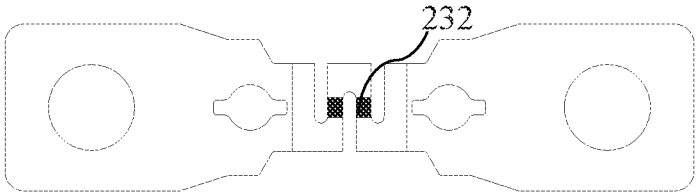
Figure 25:
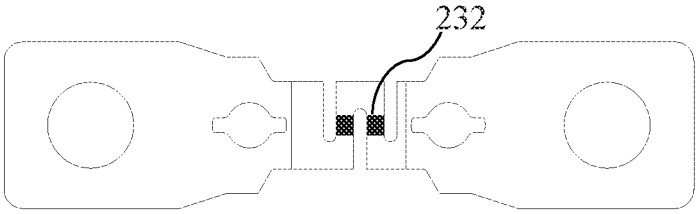

Since the housing is generally assembled by the bottom housing and the cover 11, in order to facilitate the filling of the insulating material 3 into the assembled housing, refer to FIG. 7, the housing is built with a filling hole 238 for filling the insulating material 3, and the insulating material 3 are filled through the filling hole 238 and fully filled into the cavity of the housing. When the filling is completed, the filling hole 238 is sealed by the plug body 233 to prevent the insulating material 3 from leaking. Because of the above structure, it is more convenient to fill the insulating material into the housing, and the insulating material 3 can fully fill the cavity of the entire housing, thereby improves the overall breaking capacity.

Even if the fusible parts of different types of fuses use different shapes and arrangements of through holes, the above-mentioned "common mold" principle can be used to speed up production efficiency and reduce costs. Adding "fillers" can absorb energy, thereby increasing the breaking capacity and increase the rated voltage value to its protection, so that more products are protected, benefit the people, and make society safer.

The above content is a further detailed description of the present invention in conjunction with specific preferred embodiments, and it cannot be regarded that the specific implementation of the present invention is limited to these descriptions. For those of ordinary skill in the technical field to which the present invention belongs, several simple deductions or substitutions can be made without departing from the concept of the present invention, and these should be regarded as belonging to the protection scope of the present invention.

The invention claimed is:

1. A high breaking capacity strip fuse, comprising an insulating housing and a fusing element, wherein the fusing element comprises a fusible part, a first connecting terminal, and a second connecting terminal, the fusible part, the first connecting terminal, and the second connecting terminal are arranged at two ends of the fusible part and are integrally connected with the fusible part, the fusible part is fixed in a sealed cavity of the housing, and the sealed cavity is filled with insulating material;

a surface of the fusible part is soldered with a tin layer, the housing comprises a bottom housing, and a cover matched with the bottom housing, the bottom housing is built with a fixing pole, the first connecting terminal and the second connecting terminal are both built with a fixing hole, the fixing pole is inserted into the fixing hole to fix the fusing element in the housing, the fixing hole comprises a center hole, and an anti-torsion hole arranged at an edge of the center hole, and the fixing pole is composed of a main pole and side poles, the side poles are located on two sides of the main pole, the main pole is inserted into the center hole, and the side poles are inserted into the anti-torsion hole.

2. The high breaking capacity strip fuse of claim 1, wherein the fusible part is built with a groove for restricting the tin layer at a correspondent position, and the tin layer covers and fills the groove.

3. The high breaking capacity strip fuse of claim 1, wherein the tin layer cover ⅕ to ½ area of the fusible part.

4. The high breaking capacity strip fuse of claim 1, wherein the fusible part is built with through holes.

5. The high breaking capacity strip fuse of claim 1, wherein the housing is built with a filling hole, the insulating material are filled into the housing by the filling hole and fills the cavity of the housing; and the filling hole is built with a plug for sealing.

6. The high breaking capacity strip fuse of claim 1, wherein the insulating material is silicone, quartz sand, resin, ceramic powder/ceramic sand, steatite powder/steatite sand or saponite powder/saponite granules.

7. The high breaking capacity strip fuse of claim 1, wherein the insulating material is a mixture of quartz sand, ceramic powder/ceramic sand, steatite powder/steatite sand or saponite powder/saponite granules with a curing agent; when the insulating material is filled into the housing, the insulating material is cured into a solidified shape by a curing agent.

8. A manufacture method of the high breaking capacity strip fuse of claim 1, comprising:

a shape of the fusing element is punched out by a punch with a mold;

the fusible part is milled to a specific thickness with tight dimensional accuracy according to a rated current of the fuse;

the fusible part is punched into different sizes, numbers, arrangements, combinations of round holes or profiled holes by corresponding mold according to a design;

the fusing element is proceeded surface treatment comprising plating or degreasing, and/or soldering the tin layer on the surface of the fusible part.

* * * * *